United States Patent [19]

Lane

[11] 4,263,776

[45] Apr. 28, 1981

[54] APPARATUS AND METHOD FOR INTERRUPTING TEXTILE YARN PROCESSING OPERATIONS

[75] Inventor: John E. Lane, Littleton, Mass.

[73] Assignee: Parks-Cramer Company, Charlotte, N.C.

[21] Appl. No.: 77,932

[22] Filed: Sep. 24, 1979

[51] Int. Cl.[3] ..... D01H 13/06

[52] U.S. Cl. ..... 57/87; 57/81; 57/304

[58] Field of Search ..... 57/78, 80, 81, 83, 87, 57/264, 265, 266, 268, 271, 276, 304

[56] References Cited

U.S. PATENT DOCUMENTS

| | | | |
|---|---|---|---|
| 3,413,794 | 12/1968 | Bell et al. | 57/268 X |
| 3,523,413 | 8/1970 | Ford et al. | 57/265 |
| 3,659,409 | 5/1972 | Saunders | 57/265 |
| 3,724,192 | 4/1973 | Cardoz | 57/265 X |
| 3,726,072 | 4/1973 | Ford et al. | 57/265 |
| 3,740,937 | 6/1973 | Drake | 57/81 X |

*Primary Examiner*—Donald Watkins

*Attorney, Agent, or Firm*—Bell, Seltzer, Park & Gibson

[57] ABSTRACT

A method and apparatus for reducing waste of supply strands passing to a series of yarn processing units, in which a detector moves along the yarn processing units alternately in a first direction and a second direction opposite from the first direction while sensing breakage of any one of a series of strands being delivered from the processing units and also sensing the direction of movement of the detector, and in response to sensing breakage of any strand, and irrespective of the direction of movement of the detector, passage of the corresponding supply strand is interrupted in its course to the corresponding yarn processing unit by a flowing stream of air being directed from a nozzle moving with the detector into engagement with a corresponding, normally inactive, strand interrupting member for actuating the same.

18 Claims, 4 Drawing Figures

APPARATUS AND METHOD FOR INTERRUPTING TEXTILE YARN PROCESSING OPERATIONS

FIELD OF THE INVENTION

This invention relates to traveling ends-down tending systems for textile strand or yarn processing machines, such as spinning frames, twisters and the like, and more particularly, to an improved apparatus and method for monitoring a row or series of yarn processing units alternately in a forward or first direction and in an opposite, rearward or second direction during which the absence or breakage of any strand issuing from a processing unit is detected, and in response to such detection, a corresponding supply strand passing into the processing unit is interrupted.

BACKGROUND OF THE INVENTION

It is well known that, in the production of yarn, textile strands are spun on conventional or open-end spinning machines. Also, spun strands and/or continuous filament strands are intertwisted on twisting machines. In such machines, supply strands are directed from supply sources into a row or series of processing units, and the processed strands are delivered to respective take-up means. In this regard, in the case of conventional spinning frames, the supply strands are generally in the form of rovings, and the processing units are in the form of drafting units. In the case of open-end spinning machines, the supply strands are generally in the form of slivers and the processing units generally are in the form of rotor units. In the case of twisters, the supply strands are generally in the form of spun yarns and the processing units are in the form of twister rolls or twister heads.

As set forth in U.S. Pat. No. 3,726,072, issued Apr. 11, 1973 and commonly owned by the assignee of the present application, in order to avoid the occurrence of lap-ups subsequent to the breakage of attenuated or twisted strands issuing from the processing units of a textile yarn forming machine, and to thereby avoid the wasting of stock prepared for yarn formation by delivery of the stock into the usual vacuum collection system rather than as a yarn, and thereby avoid consequent degradation of the quality of yarn produced due to the reworking of waste material, it is important that any broken processed strand be promptly and efficiently detected and that the corresponding supply strand is quickly and effectively interrupted in its course to the respective processing unit. The apparatus and method disclosed and claimed in the aformentioned patent has performed quite well and has been well accepted in the textile industry. That patent discloses the use of a traveling pneumatic cleaner serving as a carrier or carriage for a traveling detector means which monitors a series of processed strands issuing from a series of yarn processing units, such as drafting units, to which respective supply strands pass. Upon detection of a broken processed strand by such detector means, the respective supply strand is interrupted by direction of flowing air from the traveling cleaner to impinge upon and actuate a respective strand interrupting member by displacing the same from a normal or inactive position to an active position such as to engagingly restrain and thus interrupt movement of the respective supply strand into the processing unit.

Since the traveling cleaner and the detector means travel together and an individual supply strand interrupting means is provided for each yarn processing unit, the detector means is positioned so as to lead the projected flow path or "air bullet" of the directed air flow in accordance with the direction of travel of the traveling cleaner, thus providing a minimal response time for effecting the direction of the flowing air upon detection of a broken processed strand, such response time serving to insure that the "air bullet" will impinge on only the properly selected one of the strand interrupting means.

In many installations, the traveling pneumatic cleaners are constructed so that they may move alternatively in either direction, that is, the traveling cleaner may alternately traverse a textile yarn forming machine or a row or rows of such machines in opposite directions, such as in the instance of the traveling cleaner being mounted to travel on a double-ended track, or in the envent that a particular machine or a portion thereof is being repaired by persons whose efficiency might be impaired by the movement of the traveling cleaner past such persons while they are repairing the machine. Since the detector means on the traveling pneumatic cleaner leads the "air bullet" in the aforementioned patent, it can be appreciated that the timing relation between the detector means and the "air bullet" would be reversed if the direction of travel of the traveling cleaner were to be reversed. Stated otherwise, the detection of a broken processed strand by the traversing detector means would occur after the projected path of the directed air flow or "air bullet" had already moved past the supply strand interrupting means which must be actuated for interrupting the desired proper supply strand, and thus the latter supply strand would not be interrupted and a lap-up likely would occur. Also, because of the usual narrow gauge or relatively close proximity of adjacent processing units of yarn processing machines, the directed air flow or "air bullet" might impinge upon and actuate other than the desired strand interrupting member and thus cause unintentional interruption of a supply strand into a processing unit whose processed strand issuing therefrom had not been broken.

SUMMARY OF THE INVENTION

With the foregoing in mind, it is an object of this invention to further facilitate improved efficiency in the production of textile yarn by providing an improved method and apparatus for monitoring and detecting breakage of processed strands during both forward and rearward movement of a detecting means, in alternation past a corresponding series of yarn processing units, and for actuating, irrespective of the direction of movement of the detector and by air flow, a supply strand interrupting means for interrupting passage of a supply strand to any yarn processing unit corresponding to a detected broken processed strand. This object is achieved, in accordance with the present invention, by sensing breakage of any one of the strands being delivered from a series of yarn processing units by moving a detector along the yarn processing machine alternately in a first or forward direction and a second, opposite or rearward direction while sensing the direction of movement of the detector, and wherein upon the detector sensing breakage of any strand, irrespective of the direction of movement of the detector, passage of the supply strand to the corresponding yarn processing unit is interrupted by directing a flowing stream of air from a nozzle moving with the detector into engagement with a corresponding strand interrupting member.

BRIEF DESCRIPTION OF THE DRAWINGS

Some of the objects and advantages of the invention having been stated, others will appear as the description proceeds when taken in connection with the accompanying drawings, in which.

DETAILED DESCRIPTION

Referring now more particularly to the drawings, there is generally illustrated apparatus which traverses detector means along textile yarn processing machines, such as spinning frames, twisters and the like, for monitoring and detecting the absence or breakage of strands issuing from processing units, and in response to such detection, interrupting a corresponding supply strand passing into the respective processing unit.

Figure 1:
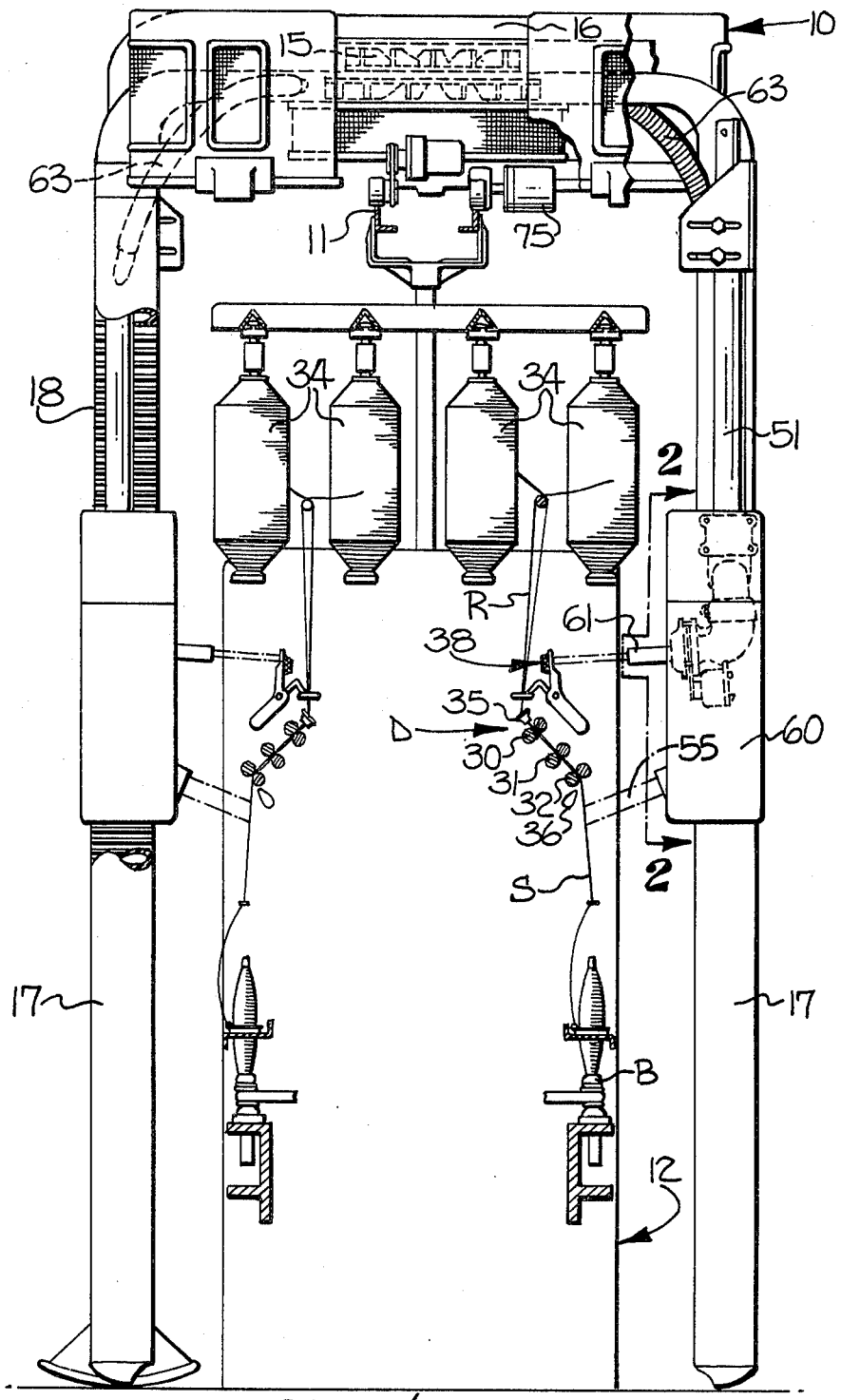
FIG. 1 is an end elevational view, with parts broken away, illustrating a preferred embodiment of the present invention.

As will be observed in FIG. 1, the present invention is particularly concerned with apparatus in which the traversing of detector means is effected by a traveling pneumatic cleaner generally indicated at 10 mounted on a track generally indicated at 11 for movement above and along a plurality of yarn processing units or spindles on at least one textile strand processing machine embodied in a spinning frame generally designated at 12. The traveling pneumatic cleaner 10 may be substantially identical to the fourth embodiment disclosed in U.S. Pat. No. 3,304,571, issued on Feb. 21, 1967, and may be equipped with a reversing mechanism of the general type disclosed in U.S. Pat. No. 3,011,204, issued on Dec. 5, 1961. As disclosed in these patents, the traveling cleaner is supported for movement along track 11 which extends above the yarn processing machine 12, and as further disclosed in the latter patent, the traveling cleaner 10 includes drive means for driving it in movement along the track so as to traverse one or more yarn forming or processing machines 10 automatically in a first or forward direction, and alternately, in a second, opposite or rearward direction. While a particular form of traveling pneumatic cleaner is described herein, it is to be understood that this choice has been made for purposes of illustration only. The present invention contemplates that the traveling unit of this invention or the manner in which the unit is supported and arranged for traversing a textile machine or machines may be changed in varying ways, including limitation of the path of travel of a unit to traverse a single machine only and/or to reverse its direction of movement in the course of traversing a single machine, such as in the instance that a particular machine or a portion thereof is being repaired by persons whose efficiency might be impaired by the movement of the traveling cleaner past such persons while they are repairing the machine.

As disclosed in the aformentioned patents, the traveling pneumatic cleaner 10 includes a fan impeller 15 and a fan drive motor (not shown) for driving the fan impeller in rotation. Fan impeller 15 is enclosed within an air flow housing 16 which, in the preferred embodiment as illustrated, is divided into a suction air flow portion and a blowing air flow portion. The blowing air flow portion of the fan housing 16 delivers flowing air through blowing sleeves 17 for the air flow to be directed against portions of the textile machine 12 for cleaning the same. In the particular form illustrated, the traveling cleaner 10 has four depending sleeves including two blowing cleaning sleeves 17 and two suction cleaning sleeves 18. As so arranged, the traveling cleaner 10 services both sides of the textile machine 12 during each traverse thereof in each direction.

In the disclosure which follows, reference will be made to only one side of the textile machine 12 and to portions of the traveling cleaner 10 which traverse the corresponding one side. Therefore, it is to be understood that the description of this invention in this context is intended only for purposes of simplifying the disclosure, as it is contemplated that both sides of the textile machine may be serviced simultaneously in accordance with the teachings of this invention. It is contemplated, however, that this disclosure may be used in conjunction with a traveling unit which services only one side of a textile machine at a time, alternating between the two sides or otherwise servicing the two sides in some prearranged sequence.

As is generally known to persons skilled in the textile arts, the textile yarn processing machine 12 includes a plurality of yarn processing units D which are shown in the form of drafting units arranged in series along the machine. Typically, and as illustrated, each drafting unit D includes an arrangement of paired rolls 30, 31, 32 through which textile material passes to be drafted or attenuated. Each drafting unit normally receives at least one corresponding supply strand or roving R.

As shown in FIG. 1, the supply strands or rovings R are led from respective packages 34 downwardly to be passed through respective trumpets 35 and thus introduced into a nip defined between the back drafting rolls 30. On passage through the yarn processing or drafting units D, the textile material is delivered from the front rolls 32 as a processed or attenuated strand S. Since a spinning frame is illustrated in FIG. 1, it is apparent that the strand S being delivered from each yarn processing unit has twist inserted therein in a generally know manner in order to form the yarn which is wound on spindle-supported bobbins or spools B. In the event of breakage of the attentuated or processed strand S issuing from any one of the processing units, textile material delivered through the delivery rolls 32 will enter a vacuum end collection nozzle 36 (FIG. 1) to be drawn into a waste collection chamber (not shown) adjacent one end of the yarn processing machine 12. Such vacuum end collection systems are generally known to persons familiar with textile yarn forming machines and have been the subject of previously granted patents.

Figure 4:
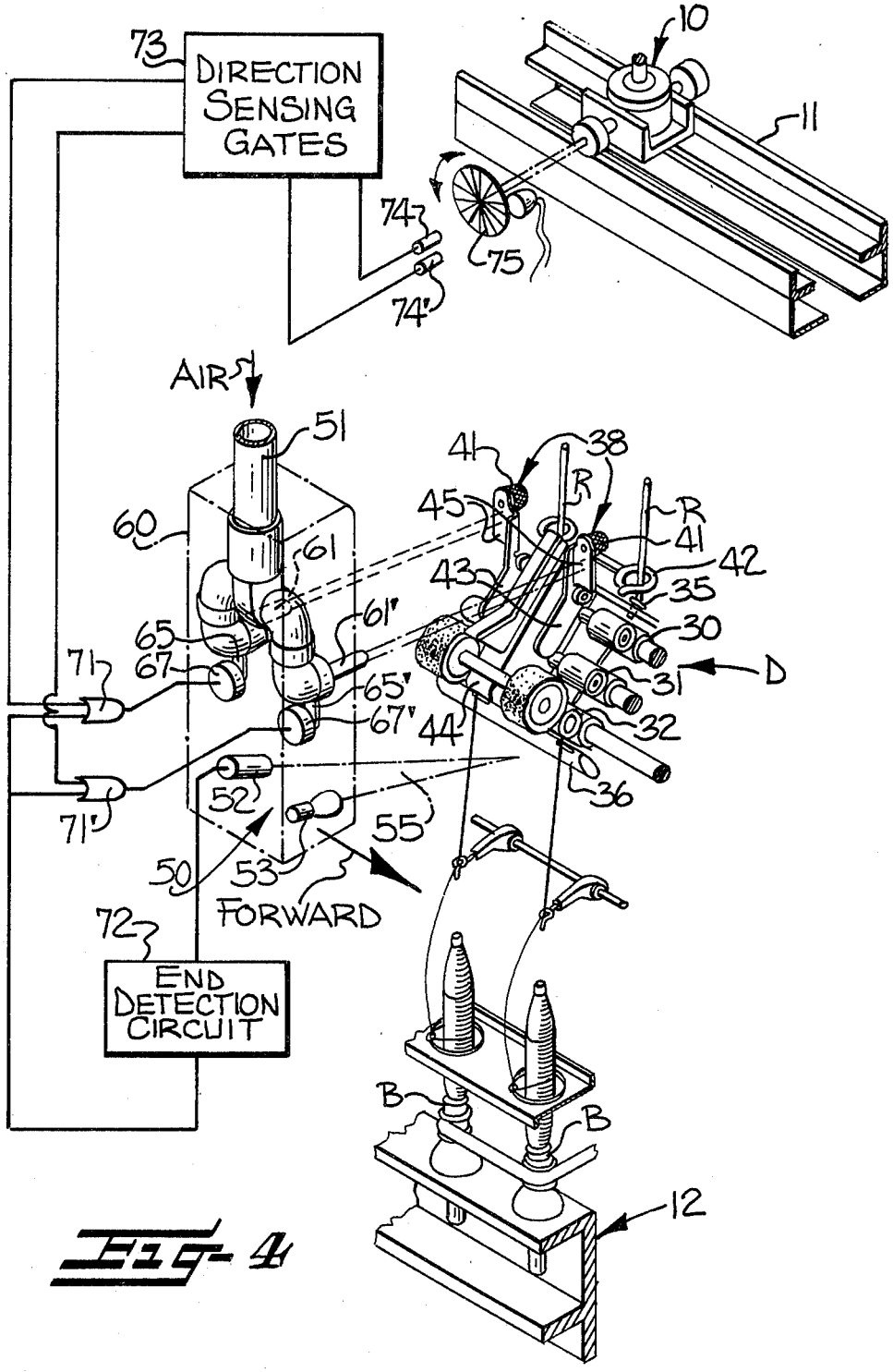
FIG. 4 is a perspective view, from one side and above, of certain portions of the structure illustrated in FIG. 1, showing an application of a preferred embodiment of the electrical circuit means of the present invention.

Mounted on the textile machine 12 is a plurality of roving feed stop members or strand interrupting members, each of which is generally designated at 38, and which correspond in number to the number of yarn processing units D, with each of the strand interrupting members 38 being mounted on the yarn processing machine 12 adjacent a corresponding one of the yarn processing units D. The strand interrupting members 38 are mounted for independent pivoting movement between a first position withdrawn from the corresponding supply strand R (as shown in FIGS. 1 and 4) and a second position intersecting the supply strand. The strand interrupting members 38 may be of any desired construction for performing the intended purpose and are shown as being of a type such as is disclosed in U.S. Pat. No. 4,000,603, issued Jan. 4, 1977, to which reference is made for a more detailed description thereof.

As best shown in FIG. 4, each strand interrupting member 38 may take the form of a plug 41 of generally truncated conical configuration and cooperating with a stationary ring means or torus 42, with the plug 41 being sized for occluding the corresponding torus 42 for engagingly restraining passage of the corresponding supply strand R therethrough in its course to the corresponding yarn processing unit D. Each plug is suitably secured to one end portion of a corresponding pivoting member 43 supported from a mounting bracket 44 for pivotal movement about an axis spaced above and outwardly of the corresponding yarn processing unit D. Each pivoting member 43 is balanced relative to its pivot point so that it normally occupies the inactive position shown in FIG. 4 with the corresponding plug 41 occupying a withdrawn or raised position with respect to the corresponding ring or torus 42. However, the portion of each pivoting member 43 having the plug 41 thereon is provided with an air impingement surface 45 which faces forwardly or outwardly with respect to the corresponding yarn processing unit D and is adapted to be impinged upon by an airstream, in a manner to be later described, for tilting the respective pivoting member 43 so that its plug 41 is moved into the corresponding torus 42 for grippingly engaging and entrapping a corresponding supply strand between the plug and the ring 42. In so doing, it is apparent that the corresponding supply strand R will be interrupted in its passage to the respective yarn processing unit. Thus, it can be seen that the strand interrupting members 38 are pivoted between a first position withdrawn from the corresponding supply strand, as shown in FIG. 4, and a second position in which they engagingly restrain the respective supply strand.

As indicated earlier herein, the strand interrupting members 38 are actuated to the second or active position in response to the sensing of the breakage of any one of the series of strands S being delivered from the yarn processing units by moving a detector along the processing machine alternately in a first direction and in a second direction opposite from the first direction to thus monitor the condition of the series of strands being delivered, and in response to the sensing of the breakage of any of the strands and irrespective of the direction of movement of the detector, the passage of the corresponding supply strand S to its yarn processing unit is interrupted by directing a flowing stream of air from a nozzle moving with the detector into engagement with a corresponding strand interrupting member 38.

Accordingly, a portion of the air flow being induced by the fan impeller 15 of the traveling pneumatic cleaner 10 is directed from the traveling pneumatic cleaner 10 and into engagement with the corresponding strand interrupting member under control of monitoring means including a detector moving with the traveling cleaner 10 along the series of yarn processing units D for detecting breakage of the processed strands S being delivered from the yarn processing units.

More particularly, the monitoring means includes a detector head 50 depending from the traveling cleaner 10 so as to be disposed between the blowing and suction sleeves 17, 18 (FIG. 1). As preferred, suspension of the detector head 50 is accomplished by means of a depending elongate mounting member or duct 51. A suitable detection device, shown in the form of a photoelectric detector 52 and a lamp 53 mounted in the lower portion of the detector head 50 in FIG. 4, is operatively connected with suitable circuitry for distinguishing between the presence and absence of attenuated or processed strands S as the monitoring means moves along the series of yarn processing units D. Detailed disclosures of various available forms of detection devices and means responsive to such detection devices need not be given here. Instead, the attention of interested persons is directed to applicable prior patents including U.S. Pat. Nos. 3,099,829; 3,486,319; 3,523,413; and 3,659,409. To the extent that the disclosures of these prior patents may be required for the purpose of fully understanding the disclosure herein made, these prior patent disclosures and hereby incorporated by reference into this disclosure.

Figure 2:
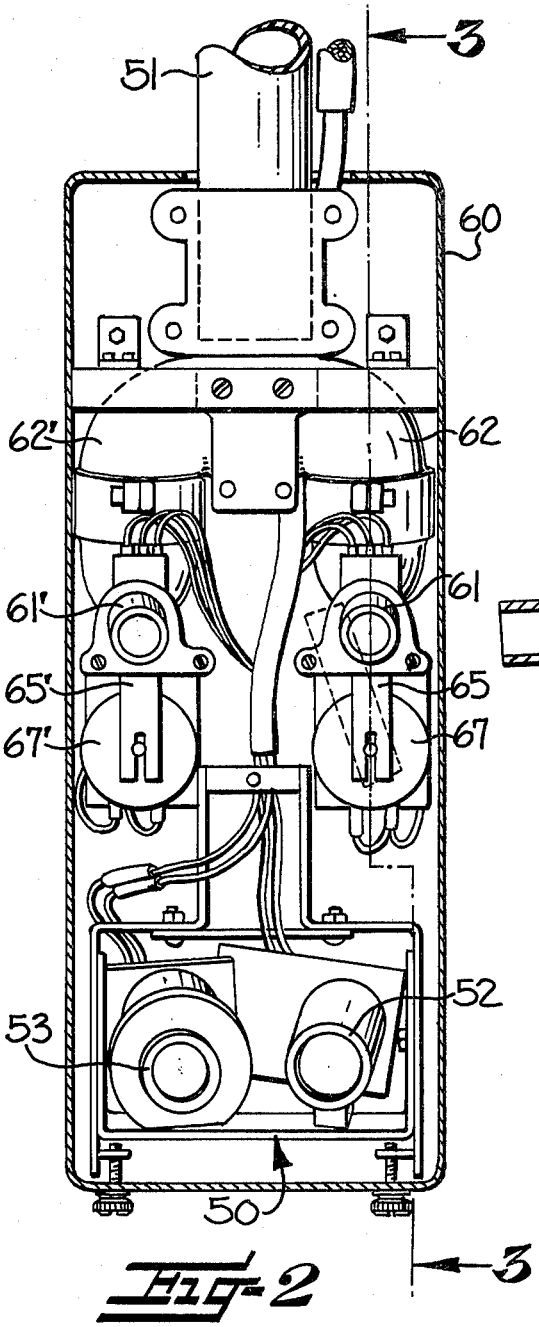
FIG. 2 is an enlarged fragmentary elevational view, partially in section, looking substantially along line 2—2 in FIG. 1 and particularly illustrating the detector means and air flow directing means adjacent one side of the textile yarn processing machine shown in FIG. 1.

As indicated by the dash and dot lines in FIGS. 1 and 4, the monitoring means of the present invention, embodied in the detector 52 and lamp 53 of FIGS. 2 and 4, has a particular predetermined field of view indicated generally at 55 within which processed strands S issuing from the yarn processing units D are viewed. During movement of the monitoring means along the series of yarn processing units, the corresponding series of processed strands S are thus monitored in succession.

According to the invention, air flow directing means is mounted for movement with the traveling cleaner 10 and is related to the monitoring means in a particular predetermined manner for assuring that a selected one strand interrupting means corresponding to the yarn processing unit at which a processed strand might be broken is actuated, irrespective of the direction of movement of the monitoring means. In the illustrated and preferred embodiment, the air flow directing means is largely positioned within and carried by a housing 60 within the lower portion of which the detector head 50 is also conveniently positioned.

In particular, the air flow directing means comprises a pair of first and second elongate outlet nozzles 61, 61′ whose outlet ends are directed toward the textile machine or yarn processing machine 12. The nozzles 61, 61′ are spaced above and astraddle the vertical plane of the field of view of the photoelectric detector 52 so that, whenever an airstream or "air bullet" flows from the first nozzle 61, which may occur only during movement of the traveling cleaner in a first or forward direction; that is, from right to left in FIG. 2 and from left to right in FIG. 4, there will be a slight trailing relation between the direction of the "air bullet" thus released and the field of view of the detection means or detector 52 (in the direction of movement of the traveling cleaner 10). On the other hand, whenever an airstream or "air bullet" flows from the second nozzle 61′, which may occur only during movement of the nozzles 61, 61′ from left to right in FIG. 2 and from right to left in FIG. 4, the airstream or "air bullet" emerging from the nozzle 61′ will have a slight trailing relation between the direction of the "air bullet" thus released and the field of view of the detector means or photoelectric detector 52 (in the direction of movement of the traveling cleaner 10, in the opposite, rearward or second direction). Thus, the air stream or "air bullet" emitted from either nozzle 61, 61' will engage the surface 45 to actuate only the desired respective strand interrupting member 38 in each instance.

The outer ends of the nozzles 61, 61', that is the ends of the nozzles 61, 61' remote from the textile machine 12, are connected, via respective valve means, to branch ducts or pipe elbows 62, 62' which extend upwardly and are communicatively connected to the lower end of the depending member or conduit 51. The upper end of the conduit 51 communicates with the outlet side of the fan housing 16 by means of a corresponding flexible conduit 63 (FIG. 1).

Figure 3:
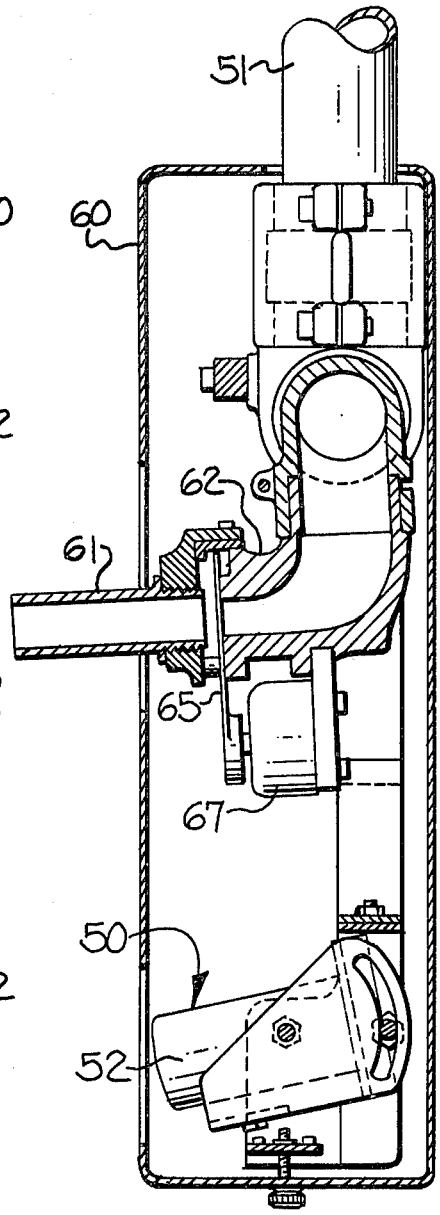
FIG. 3 is a vertical sectional view taken substantially along line 3—3 in FIG. 2.

As best shown in FIGS. 2 and 3, the valve means associated with the air flow nozzles 61, 61' comprises a pair of respective elongate flap valve members 65, 65' which are normally biased to closed positions blocking the outlet ends of the respective pipe fittings or pipe elbows 62, 62' to prevent the flow of air therefrom outwardly through the respective nozzels 61, 61'. As shown in FIGS. 2 and 3, the flap valve members 65, 65' extend downwardly through suitable openings between the respective pipe fittings or elbows 62, 62' and the nozzles 61, 61'. The flap valve members 65, 65' are mounted on the output shafts of respective rotary solenoids 67, 67' serving as respective electromagnetic means for operating the valve members 65, 65'.

The solenoids 67, 67' are suitably supported in the housing 60 and are electrically connected to respective "AND" gates 71, 71'. Corresponding sides of the "AND" gates 71, 71' are connected to a common end detection circuit 72 to which the photoelectric detector 52 is electrically connected. The end detection circuit 72 may be of the type such as is shown in FIG. 11 of U.S. Pat. No. 3,523,413 or FIG. 7 of U.S. Pat. No. 3,659,409. Accordingly, a further description of the end detection circuit is deemed unnecessary. However, to the extent that the disclosures of U.S. Pat. Nos. 3,523,413 and 3,659,409 may be required for the purpose of fully understanding the disclosure herein made, these latter prior patent disclosures are hereby incorporated by reference into this disclosure.

The sides of the "AND" gates 71, 71' opposite from the sides to which the end detection circuit 72 are connected, are connected to opposite sides of direction sensing gates shown diagrammatically at 73 in FIG. 4. The direction sensing gates have respective direction sensing elements or cells 74, 74' electrically connected thereto which produce signals in the direction sensing gates 73 in accordance with the direction of rotation of a so-called tachometer 75 which rotates with one or more of the track engaging wheels of the traveling pneumatic cleaner 10, thus reflecting the direction of travel of the traveling cleaner 10 along the track 11. The construction and operation of direction sensing gates such as are indicated at 73 in FIG. 4 are well known to those familiar with the art of electrical circuitry and from prior patents and trade publications. Accordingly, a detailed description and illustration thereof is deemed unnecessary.

It is to be noted that, whenever the tachometer 75 of FIG. 4 is rotating in a direction corresponding to the forward or first direction of movement of the traveling cleaner 10, the sensing element 74 signals the direction sensing gates 73 and thus the "And" gate 71 is actuated to "ready," the solenoid 67 for energization thereof upon the detector 52 sensing breakage of any one of the series of strands S being delivered from the yarn processing units during movement of the traveling cleaner in the first or forward direction. Thus, the solenoids 67 will be actuated in response to the sensed breakage of the corresponding strand S and the flap valve member 65 will then be moved to open position to permit a rush of air or "air bullet" to flow out of the then trailing nozzle 61 and to impinge against the respective strand interrupting member 38 and thereby move such strand interruption member to the active position for engagingly restraining the corresponding roving or supply strand R, thus interrupting the same in its course to the corresponding yarn processing unit and thus preventing any substantial amount of the supply yarn from being drawn into the corresponding vacuum end collection nozzle 36 (FIG. 1), to be drawn into the waste collection chamber as heretofore described.

Typically, the interval of time within which the air flow through either air discharge nozzle 61, 61' must be started and stopped to actuate one roving stop member or strand interrupting member 38 is about 1/5 second. As described, the first and second nozzles 61, 61' are so located relative to detector 52 that the line of flow of air or "air bullet" whenever discharged from either nozzle, is between the normal paths of supply strands S being received by adjacent yarn processing units D. Also, such lines of flow of the air from the first and second nozzles 61, 61'trail behind the detector 52 during movements thereof in the aforementioned respective first and second directions. Accordingly, as described in the last-mentioned U.S. Pat. Nos. 3,523,413 and 3,659,409, time delay means (not shown) is included in and operably associated with the end detection circuit 72 (FIG. 4) for delaying the opening of each first and second nozzle 61, 61' upon the detector means or detector 52 sensing breakage of a processed strand S so that the line of flow of air from each nozzle will pass a preceding unbroken supply strand R before the corresponding airstream or "air bullet" is discharged from the respective nozzle and in accordance with the direction of movement of the detector means, or stated otherwise, until such nozzle is properly aimed with respect to the appropriate strand interrupting member.

From the foregoing description, it is apparent that, upon rotation of the tachometer 75 of FIG. 4 in the reverse direction, which indicates that the traveling cleaner 10 is moving in the second, reverse or rearward direction, the sensing element 74', operating through the direction sensing gates 73, will excite the "And" gate 71' to "ready" the solenoid 67' trailing the field of view of the detector 52, as the nozzles 61, 61' and detector 52 are moving from left to right in FIG. 2 and from right to left in FIG. 4, so that the airstream will be emitted from only the second nozzle 61' following the detection of breakage of a processed strand S by the detecting means or detector 52.

Although the tachometer 75 has been described as a preferred means for sensing the direction of movement of the traveling cleaner 10, it is apparent that the usual plunger means for changing the direction of movement of the traveling cleaner, such as that disclosed in said U.S. Pat. No. 3,011,204, may be employed for actuating a suitable switch or the like for effecting the proper operation of the direction sensing gates 73 and the "And" gates 71, 71' to assure that the valve means for the "trailing" nozzle is that one which is opened in response to the sensing of the breakage of any one of the series of strands being delivered from the yarn processing units by the detector 52, irrespective of the direction of movement of the detector.

Although the apparatus of FIGS. 2, 3 and 4 is equipped with two air nozzles 61, 61', it is to be understood that a single nozzle with a single valve means comparable to the valve members 65, 65' may be employed, in which instance the single nozzle then being used may be pivoted from side to side under control of a suitable solenoid or other mechanism, without departing from the invention, for directing the "air bullet" in the desired direction at the proper time in response to the sensing of the breakage of any one of the series of strands being delivered from the yarn processing units by the detector 52.

In the drawings and specifications, there have been set forth preferred embodiments of the invention and, although specific terms are employed, they are used in a generic and descriptive sense only, and not for purposes of limitation.

That which is claimed is:

1. A method of reducing waste of supply strands passing to a plurality of yarn processing units, such as drafting units, arranged in a series along a textile yarn processing machine, such as a yarn spinning machine, upon breakage of corresponding strands being delivered from the yarn processing units, the method comprising the steps of:

sensing breakage of any one of the series of strands being delivered from the yarn processing units by moving a detector along the processing machine alternately in a first direction and in a second direction opposite from the first direction to thus monitor the condition of the series of strands being delivered, and in response to the sensed breakage of any strand and irrespective of the direction of movement of the detector, interrupting passage of the corresponding supply strand to its yarn processing unit by directing a flowing stream of air from a nozzle moving with the detector into engagement with a corresponding strand interrupting member.

2. A method of reducing waste of supply strands passing to a plurality of yarn processing units, such as drafting units, arranged in a series along a textile yarn processing machine, upon breakage of corresponding strands being delivered from the yarn processing units, the method comprising the steps of:

sensing breakage of any one of the series of strands being delivered from the yarn processing units by moving a detector along the processing machine alternately in a first direction and in a second direction opposite from the first direction to thus monitor the condition of the series of strands being delivered, sensing the direction of movement of the detector along the processing machine, and in response to the detector sensing the breakage of any strand and to the sensing of the direction of movement of the detector, interrupting passage of the corresponding supply strand to its yarn processing unit by directing a flowing stream of air from a nozzle moving with the detector to a location trailing the detector and into engagement with a respective strand interrupting member.

3. A method of reducing waste of supply strands passing to a plurality of yarn processing units, such as drafting systems, arranged in a series along a textile yarn processing machine, such as a yarn spinning machine, upon breakage of corresponding strands being delivered from the yarn processing units, the method comprising the steps of:

inducing a flow of air and moving the induced flow of air along the processing machine alternately in a first direction and in a second direction opposite from the first direction while directing the flowing air against the machine for cleaning the same, sensing breakage of any one of the series of strands being delivered from the processing units by moving a detector along with the induced flow of air to thus monitor the condition of the strands being delivered, and in response to sensing breakage of any strand, irrespective of the direction of movement of the induced flow of air and the detector moving therewith, interrupting passage of the corresponding supply strand to its yarn processing unit by directing a flowing stream of air from the induced flow of air through a nozzle moving with the induced flow of air and the detector and into engagement with a corresponding strand interrupting member.

4. A method according to claim 3 including the further step of sensing the direction of movement of the detector along the processing machine, and wherein the flowing stream of air is directed from the nozzle moving with the detector to a location trailing the detector in response to the sensed direction of movement of the detector.

5. A method according to either of claims 2 or 4 wherein there is provided a pair of nozzles moving with the detector with one nozzle leading and one nozzle trailing the detector and further wherein the flowing stream of air is directed from the trailing nozzle in response to the sensed direction of movement of the detector.

6. A method according to claim 5 including the further step of delaying the direction of the air stream from the trailing nozzle until such nozzle is properly aimed with respect to the appropriate strand interrupting member.

7. In a textile yarn processing machine, such as a yarn spinning machine, having a plurality of yarn processing units, such as drafting units, arranged in a series along the yarn processing machine, the combination therewith of apparatus for reducing waste of supply strands passing to the yarn processing units upon breakage of corresponding strands being delivered from the yarn processing units, said apparatus comprising:

means for sensing breakage of any one of the series of strands being delivered from the yarn processing units and including a detector movable along the processing machine alternately in a first direction and in a second direction opposite from the first direction for monitoring the condition of the series of strands being delivered, and means operable in response to said detector sensing the breakage of any strand being delivered and irrespective of the direction of movement of said detector for interrupting passage of the corresponding supply strand to its respective yarn processing unit, said means operable in response to said detector including a normally inactive strand interrupting member associated with each yarn processing unit and adapted to be actuated by a flow of air thereagainst, and means responsive to the sensing of the breakage of any strand by said detector for directing an air stream from adjacent said detector into engagement with said strand interrupting member for actuating the same.

8. Apparatus according to claim 7 wherein said means for directing an air stream into engagement with said strand interruption member comprises first and second air discharge nozzles movable with said detector, and valve means normally closing said nozzles to the outward flow of air therethrough, and further wherein said means responsive to the sensing of the breakage of any strand by said detector includes means operably connected to said valve means for opening said first nozzle to the flowof air therethrough during the movement of said detector in said first direction and for opening said second nozzle to the flow of air therethrough during the movement of said detector in said second direction.

9. Apparatus according to claim 8 wherein said first and second air discharge nozzles are so located relative to said detector that the line of flow of air whenever discharged from either nozzle is located between the normal paths of supply strands passing to adjacent yarn processing units, and wherein such lines of flow of the air from said first and second nozzles trail behind said detector during movements thereof in said respective first and second directions.

10. Apparatus according to claim 9 further comprising time delay means operably associated with said means responsive to the sensing of the breakage of any strand by said detector for delaying the opening of each first and second nozzle upon said detector sensing breakage of a strand until such nozzle is properly aimed with respect to the appropriate strand interrupting member.

11. In a textile yarn processing machine, such as a yarn spinning machine, having a plurality of yarn processing units, such as drafting units, arranged in a series along the yarn processing machine, the combination therewith of apparatus for reducing waste of supply strands passing to the yarn processing units upon breakage of corresponding strands being delivered from the yarn processing units, said apparatus comprising:

detector means movable along the processing machine alternately in a first direction and in a second direction opposite from said first direction for sensing breakage of any one of the series of strands being delivered from the yarn processing units, means moving with said detector means for inducing a flow of air and for directing the flowing air against the machine for cleaning the same, means for sensing the direction of movement of said detector means along the yarn processing machine, means responsive to sensing of breakage of a strand by said detector means and to sensing the direction of movement of said detector means for directing a portion of the air flow from said air flow inducing means in a predetermined direction generally toward the corresponding supply strand, and means actuated by such directed portion of the air flow for engagingly restraining and thereby interrupting passage of the corresponding supply strand to the corresponding yarn processing unit.

12. Apparatus according to claim 11 wherein said means for directing a portion of the air flow toward the corresponding supply strand comprises:

conduit means communicating with said air flow inducing means, first and second air discharge nozzles moving with said detector means, valve means interposed between said conduit means and said nozzles and normally closing said nozzles to the flow of air therethrough, and said means responsive to sensing of breakage of a strand and to sensing the direction of movement of said detector means including means operably connected to said valve means for opening said first nozzle to the flow of air therethrough during the movement of said detector means in said first direction and for opening said second nozzle to the flow of air therethrough during the movement of said detector means in said second direction.

13. Apparatus according to claim 12 wherein said first and second air discharge nozzles are so located relative to said detector means that the line of flow of air whenever discharged from either nozzle is located between the normal paths of supply strands passing to adjacent yarn processing units, and wherein such lines of flow of the air from said first and second nozzles trail behind said detector means during movements thereof in said respective first and second directions.

14. Apparatus according to claim 13 further comprising time delay means operably associated with said means responsive to sensing of breakage of a strand by said detector means, for delaying the opening of each first and second nozzle upon said detector means sensing breakage of a strand until such nozzle is properly aimed with respect to the appropriate strand interrupting means.

15. In a textile yarn processing machine, such as a spinning machine, having a plurality of yarn processing units, such as drafting units, arranged in a series along the yarn processing machine, the combination therewith of apparatus for reducing waste of supply strands passing to the yarn processing units upon breakage of corresponding strands being delivered from the yarn processing units, said apparatus comprising:

traveling cleaner means traversing the machine alternately in a first direction and a second direction opposite from said first direction for inducing flow of air against portions of the machine for thereby cleaning the machine, means for sensing the direction of traversing of said traveling cleaner means, detector means carried by and moving with said traveling cleaner means for sensing breakage of any one of the strands being delivered from the yarn processing units, means responsive to sensing the breakage of a strand and to sensing the direction of traversing of said traveling cleaner means for directing a portion of the air flow induced by said traveling cleaner means generally toward the corresponding supply strand, and means actuated by the thus directed portion of the air flow for engagingly restraining and thereby interrupting passage of the corresponding supply strand to the corresponding yarn processing unit.

16. Apparatus according to claim 15 wherein said means for directing a portion of the air flow toward the corresponding supply strand comprises:

conduit means communicating with said traveling cleaner means for directing a flow of air therefrom, first and second air discharge nozzles movable with said detector means, valve means for selectively effecting communication between said conduit means and said nozzles and normally closing said nozzles to the flow of air therethrough, and said means responsive to sensing of breakage of a strand including means operably connected to said valve means for opening said first nozzle to the flow of air from said conduit means therethrough during only that traversing of said detector means in said first direction and for opening said second nozzle to the flow of air from said conduit means therethrough during only that traversing of said detector means in said second direction.

17. Apparatus according to claim 16 wherein said first and second air discharge nozzles are so located relative to said detector means that the flow of air discharged from either nozzle extends through the space defined between the normal paths of adjacent supply strands in their respective courses to adjacent yarn processing units with the flows of air from said first and second nozzles being spaced behind said detector means during the traversing movements of said detector means in the respective first and second directions.

18. Apparatus according to claim 17 further comprising time delay means operably associated with said means responsive to sensing of breakage of a strand for delaying the opening of each first and second nozzle upon said detector means sensing breakage of a strand until such nozzle is properly aimed with respect to the appropriate strand interrupting means.

* * * * *